United States Patent [19]

Rhodes et al.

[11] Patent Number: 4,493,763

[45] Date of Patent: Jan. 15, 1985

[54] PRETREATMENT OF OIL-SHALE FOR ENHANCED ARSENIC REMOVAL

[75] Inventors: Richard P. Rhodes, Westfield; Frank Hershkowitz, Liberty Corner, both of N.J.

[73] Assignee: Exxon Research and Engineering Co., Florham Park, N.J.

[21] Appl. No.: 513,824

[22] Filed: Jul. 15, 1983

[51] Int. Cl.[3] ..... C10G 1/00

[52] U.S. Cl. ..... 208/11 R

[58] Field of Search ..... 208/11 R, 251 H, 251 R

[56] References Cited

U.S. PATENT DOCUMENTS

| | | | |
|---|---|---|---|
| 2,908,617 | 10/1959 | Murphree | 208/11 R |
| 3,224,954 | 12/1965 | Schunger et al. | 208/11 R |
| 3,484,364 | 12/1969 | Hemminger | 208/11 R |
| 3,617,472 | 11/1971 | Schlinger | 208/11 R |
| 4,127,469 | 11/1978 | Young | 208/11 R |
| 4,159,241 | 6/1979 | Simo | 208/251 H |

*Primary Examiner*—Delbert E. Gantz
*Assistant Examiner*—A. McFarlane
*Attorney, Agent, or Firm*—Henry E. Naylor

[57] ABSTRACT

Disclosed is a method for pretreating oil-shale such that upon subsequent processing the shale-oil obtained is substantially free of arsenic. The pretreatment comprises heating the oil-shale in a reducing atmosphere at a temperature from about 200° C. to about retorting temperature.

4 Claims, No Drawings

PRETREATMENT OF OIL-SHALE FOR ENHANCED ARSENIC REMOVAL

This invention relates to a method for pretreating oil-shale such that upon subsequent processing shale-oil is obtained which is substantially free of arsenic. The pretreatment comprises heating the oil-shale in a reducing atmosphere at a temperature from about 250° C. to about retorting temperature.

BACKGROUND OF THE INVENTION

Oil-shale is still considered by many as a major transition energy source which will someday be needed as a bridge between the petroleum era and the potentially unlimited energy sources of the future, such as solar power and nuclear fusion. As a result, much work is still being done to provide economical methods of converting the organic material of oil-shale to valuable liquid and gaseous products. Although many conversion schemes have been developed over the years for obtaining useful liquids from oil-shale, the presence of arsenic in oil-shale liquids is very deleterious because it poses a serious environmental problem and is a catalyst poison upon subsequent utilization of these liquids.

Most conventional methods developed for dealing with this arsenic problem treat the arsenic-containing oil after conversion as opposed to treating the oil-shale before conversion.

Consequently, there is a need in the art for methods of treating oil-shale, prior to conversion, so that upon conversion liquids and gaseous products are produced which are substantially free of arsenic.

SUMMARY OF THE INVENTION

In accordance with the present invention there is provided a method for pretreating oil-shale such that upon subsequent conversion, the resulting oil-shale liquids have substantially less arsenic than if the oil-shale had not been so pretreated. The method comprises subjecting the oil-shale to a temperature at or below which the oil-shale begins to retort for an effective amount of time, and in an effective reducing environment.

In a preferred embodiment of the present invention the reducing atmosphere is employed at a temperature of about 200° C. to 400° C. and is provided by hydrogen, carbon monoxide, or mixtures thereof. The reduced oil-shale is subsequently retorted using conventional methods.

In another preferred embodiment of the present invention the oil-shale is treated in a reducing atmosphere and subsequently retorted using the same atmosphere and vessel by means of temperature manipulation.

DETAILED DESCRIPTION OF THE INVENTION

Any type of arsenic containing oil-shale may be treated by the practice of the present invention. It is preferred that the oil-shale have as high a surface area as possible, although, it is generally not economically justifiable to pulverize it to a fine powder. Consequently, it is desired to expose as much of the surface of the oil-shale as possible, without losing material such as dust or fines, or as the economics of grinding or process equipment may dictate. Generally, for purposes of the present invention, the oil-shale will be ground to a relatively finely divided state and will contain a majority of particles less than about 4 mesh, U.S. Sieve Size.

The temperature at which the oil-shale is pretreated in accordance with the present invention is from about 200° C. to about the retorting temperature of the oil-shale. The term retorting temperature as used herein means the lowest temperature at which conversion to liquids and gases begins at the conditions employed. Of course, the precise retorting temperature may vary for any given oil-shale and pretreatment conditions employed. In general, an oil-shale such as Green River oil-shale will start to yield liquids, gases, or both at a temperature of about 350° C. It is preferred to use a pretreatment temperature of about 200° C. to about 400° C., more preferred is a temperature of about 250° C. to about 350° C., most preferred is a temperature of about 350° C.

The pretreatment of the present invention must be performed in an effective reducing atmosphere. Non-limiting examples of effective reducing atmospheres which may be used herein include hydrogen, carbon monoxide, and mixtures thereof. Preferred is a hydrogen atmosphere, that is a gaseous atmosphere containing more than 50% hydrogen by volume. By effective reducing atmosphere, we mean an atmosphere sufficiently reducing such that it permits reduction of the oxidation state of the arsenic compounds of the oil-shale.

After the oil-shale is heated to a temperature between 200° C. and retorting temperature, in a reducing atmosphere, it is maintained at that temperature and in that atmosphere for an effective amount of time. The term effective amount of time as used herein means for at least that amount of time which permits reduction of the oxidation state of the arsenic compounds of the oil-shale. The effective amount of time, of course, will vary depending on such things as the arsenic content of the oil-shale, the type oil-shale being treated, the temperature of pretreatment, and the partial pressure of the reducing atmosphere. In general, for Green River oil-shale and a pretreatment temperature of about 350° C., an effective amount of time would be about 10–20 minutes.

Any conventional reaction vessel may be used in the practice of the present invention as long as it is capable of operating under the reaction conditions required herein.

In one preferred method for obtaining oil-shale liquids in accordance with the present invention, the oil-shale is fed into a reaction vessel and the reducing atmosphere is provided. The vessel is held at that temperature for an effective amount of time while still maintaining the reducing atmosphere. The atmosphere is then switched to the atmosphere selected for conversion and the temperature of the vessel is increased to retorting temperature.

The following examples serve to more fully describe the manner of practicing the above-described invention, as well as to set forth the best modes contemplated for carrying out various aspects of the invention. It is understood that these examples in no way serve to limit the true scope of this invention, but rather, are presented for illustrative purposes.

EXAMPLES

For each of the examples of Table I below, 200 g samples of Colorado oil-shale (−20/+60 mesh) was fed into a fixed bed retort reactor. In all runs, the oil-shale sample was: heated at a rate of 30° C./minute to the pretreat temperature, in the atmosphere indicated, and held at that temperature and in that atmosphere for the time indicated in Table I below. The atmosphere was then (in some cases) switched, as indicated in the table and the pretreated oil-shale was then retorted by heating it at a rate of about 6° C./minute to a temperature of 600° C. Liquid product was collected and analyzed for arsenic by x-ray fluorescence spectroscopy techniques. The results are shown in Table I.

Comparative Examples A and B demonstrate that preheating in a non-reducing atmosphere results in high arsenic levels in collected oil. Examples 1 through 4 demonstrate lower arsenic levels in collected oils when prereduction is used and followed by inert atmosphere retorting. Examples 5 and 6 demonstrate lower arsenic levels in converted oils when the same reducing atmosphere is maintained in pretreatment and retorting steps.

TABLE I

| | | Pretreatment | | | |
|---|---|---|---|---|---|
| Example | Atm. | Temp (°C.) | Time (min.) | Retort Atm. | Arsenic in liquid (ppm) |
| Comparative Example A | $N_2$ | 300 | 60 | $N_2$ | 11.1 |
| Comparative Example B | $N_2$ | 300 | <5 | $N_2$ | 10.1 |
| 1 | $H_2$ | 250 | 30 | $N_2$ | 2.9 |
| 2 | $H_2$ | 250 | 30 | $N_2$ | 5 |
| 3 | $H_2$ | 300 | 30 | $N_2$ | 5.3 |
| 4 | $H_2$ | 350 | 20 | $N_2$ | 1 |

TABLE I-continued

| | | Pretreatment | | | |
|---|---|---|---|---|---|
| Example | Atm. | Temp (°C.) | Time (min.) | Retort Atm. | Arsenic in liquid (ppm) |
| 5 | $H_2$ | 250 | 15 | $H_2$ | <1 |
| 6 | $H_2$ | 300 | <5 | $H_2$ | 2.9 |

The above table illustrates the criticality of pretreating of the oil-shale in accordance with the present invention for obtaining a liquid oil-shale product having substantially less arsenic then that obtained from oil-shale which was not pretreated in accordance with the present invention.

What is claimed is:

1. A method for pretreating oil-shale such that upon subsequent conversion, the resulting oil-shale liquids have substantially less arsenic than if the oil-shale had not been so pretreated, the method comprising subjecting the oil-shale to a temperature from about 250° C. to just below the temperature at which the oil-shale begins to retort, for an effective amount of time and in a reducing environment wherein the reducing agent is selected from hydrogen, carbon monoxide, and mixtures thereof to cause reduction of the oxidation state of the arsenic compounds of the oil-shale.

2. The method of claim 1 wherein the temperature is from about 250° C. to about 400° C.

3. The method of claim 1 wherein the pretreated oil-shale is subjected to retorting.

4. The method of claim 3 wherein the retorting is conducted in the same reducing atmosphere as the pretreatment.

* * * * *